United States Patent [19]

Blacket

[11] Patent Number: 4,655,193

[45] Date of Patent: Apr. 7, 1987

[54] INCINERATOR

[76] Inventor: Arnold M. Blacket, 5 Powys Drive, Beaumaris, Victoria 3193, Australia

[21] Appl. No.: 741,563

[22] Filed: Jun. 5, 1985

[30] Foreign Application Priority Data

Jun. 5, 1984 [AU] Australia ..... PG5365

[51] Int. Cl.[4] ..... F23G 5/00

[52] U.S. Cl. ..... 126/224; 110/235; 126/151

[58] Field of Search ..... 126/224, 59.5, 64, 146, 126/145, 151; 110/235, 236, 241

[56] References Cited

U.S. PATENT DOCUMENTS 1,622,431 3/1927 Feigenbaum ..... 110/235
1,957,220 5/1934 Mallhi ..... 126/151 X
2,271,828 2/1942 Peawuk ..... 126/224 X
2,399,490 4/1946 Lange ..... 126/151 X

FOREIGN PATENT DOCUMENTS 2354 of 1877 Fed. Rep. of Germany ..... 110/235

*Primary Examiner*—Randall L. Green
*Attorney, Agent, or Firm*—Arnold, White & Durkee

[57] ABSTRACT

An incinerator comprising reinforced concrete panels secured together in an array on a base plate to define a vertical enclosure with narrow gaps between adjacent panels, the panels being secured together in the array by a metal ring that extends around the upper ends of the panels and a removable top assembly that is designed to act both as a weather protective roof and a chimney to improve the drawing capacity of the incinerator.

13 Claims, 8 Drawing Figures

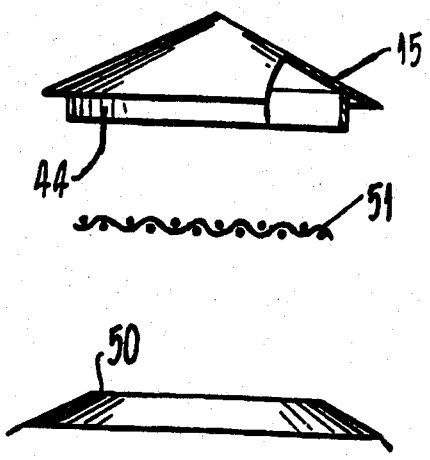
FIG. 3.
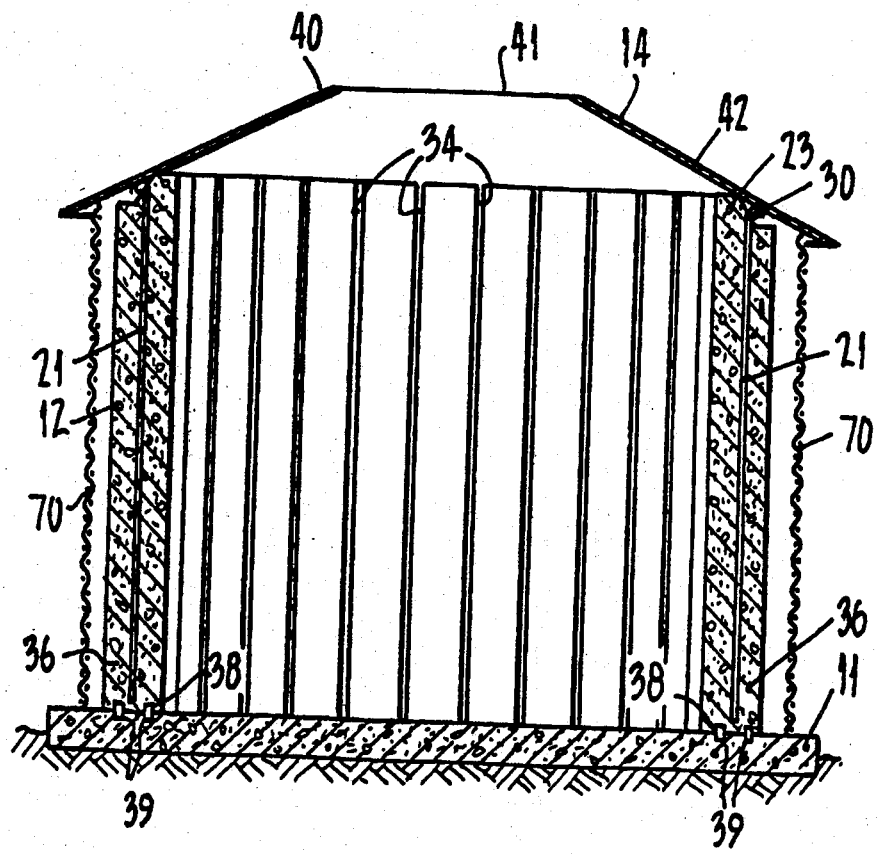

INCINERATOR

This invention relates to incinerators and in particular to incinerators for use in the disposal of garden waste.

Many gardens have an incinerator. Incinerators have proved very useful in the disposal of household and garden waste especially leaves, prunings and paper waste such as cardboard boxes.

The conventional design of a garden incinerator is a vertical enclosure defined by a pre-cast concrete cylinder or concrete blocks formed into a rectangular or cylindrical enclosure. The top of the incinerator is normally open and the incinerator is loaded through the top. The base of the incinerator is provided with an aperture to allow both ingress of air and removal of ash. The use of such incinerators is infrequent as is the removal of ash that collects at the bottom of the incinerator. The design of the incinerator combined with its infrequent use and ash removal leads to a number of problems.

It is well known that good or complete combustion takes place when the combustible product has ready access to air. The combination of dampness and lack of oxygen tends to produce incomplete combustion, the effect of which causes generation of smoke and at times toxic and harmful gases.

Because incinerators are left for lengthy periods in the open the ash in the base of the incinerator becomes damp as often do the contents of the incinerator, the dampness being caused by rain water that passes through the open top of the incinerator. The collection of damp ash in the base of the incinerator also prevents the entry of the required quantity of air to cause good combustion. Consequently garden incinerators are considered hazardous to the environment and their use often causes considerable inconvenience to the owners of adjacent properties because of the high generation of smoke.

This invention relates to an incinerator that is designed to overcome many of the disadvantages with existing incinerators.

According to the present invention there is provided an incinerator comprising pre-cast concrete panels secured together in an array to define a vertical enclosure with narrow gaps between adjacent panels, and a removable top assembly that is designed to act both as a weather protective roof and a chimney to improve the drawing capacity of the incinerator.

Preferably the panels are secured in the array by a metal ring that extends around the upper ends of the panels. The panels may be arranged in a circular array but other cross-sections are also envisaged. The panels are preferably cast so that each panel has a bent metal rod extending from one end, the rod being arranged to be hooked onto the metal ring.

A pre-cast or cast in situ concrete base plate may be provided with means in which the lower ends of the panels are located.

In a preferred embodiment the removable top assembly comprises a frusto-conical sheetmetal cover member that sits on the upper end of the assembled panels and a cap of conical profile that is arranged to sit on the upper end of the cover member. Preferably the cap is removable to allow in use entry of material to be incinerated through the cover member and to act when attached as a rain deflector. The cover member preferably acts as a heat sink or chimney to cause improved convection.

A spark arrester in the form of metal gauze may be positioned over the cover member to prevent escape of sparks but allow free escape of smoke.

Entry of air to ensure good combustion is facilitated through the longitudinal gaps between adjacent panels. The assembly of panels may be arranged so that the longitudinal gaps increase in cross-section towards the base of the incinerator.

Ash may be removed by lifting out two or more of the panels or by the provision of a door in the wall of the incinerator adjacent the incinerator base.

The present invention will now be described by way of example only with reference to the accompanying drawings in which:

FIG. 3 is an exploded cross-sectional view taken along the lines B—B of FIG. 2;

Figure 1:
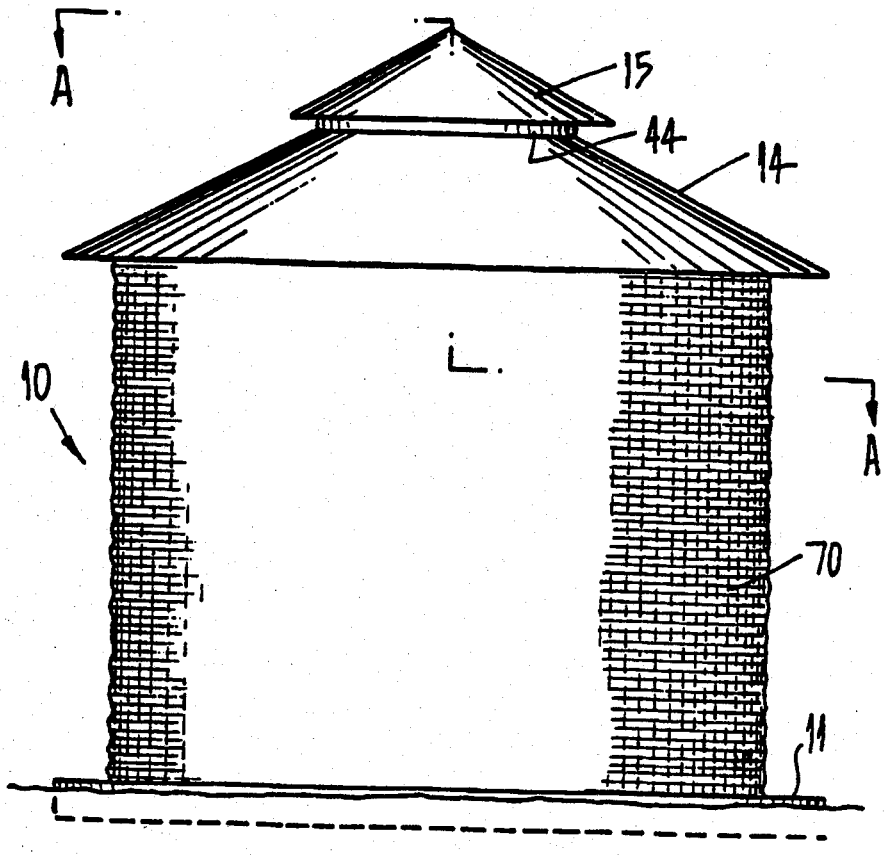
FIG. 1 is a side elevational view of an incinerator.

An incinerator 10 as illustrated in the accompanying drawings comprises a pre-cast concrete base member 11 of circular cross-section, a plurality of vertical panels 12 that are secured together slightly spaced apart to define a cylindrical array 13. A cover member 14 of frusto-conical profile is arranged to be positioned on top of the panels and a conical cap 15 is positioned over the cover member 14.

Figure 4B:
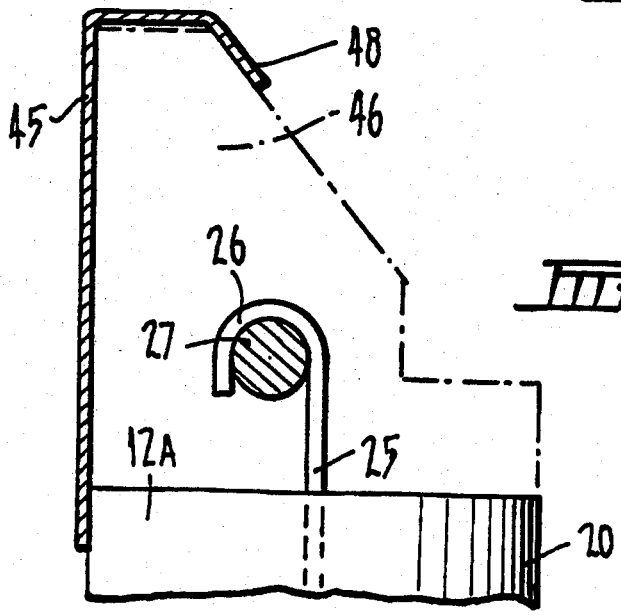
FIG. 4B is a view similar to FIG. 4A but illustrating the means of securing an ash removal panel.
Figure 2:
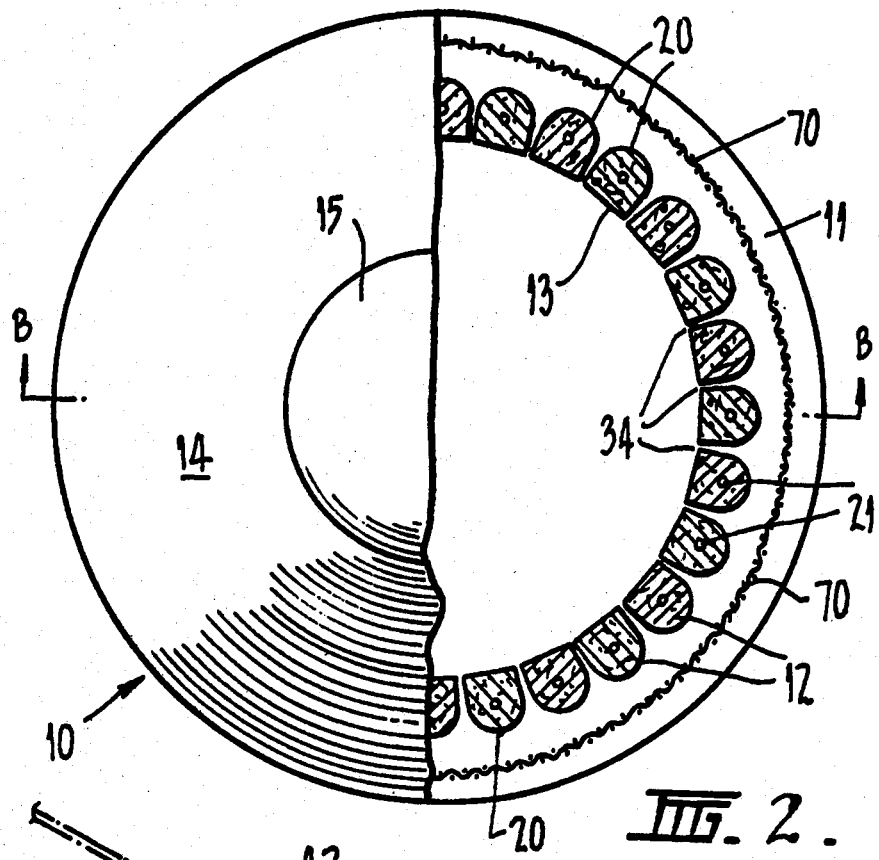
FIG. 2 is a cross-sectional view taken on the lines A—A of FIG. 1.
Figure 4A:
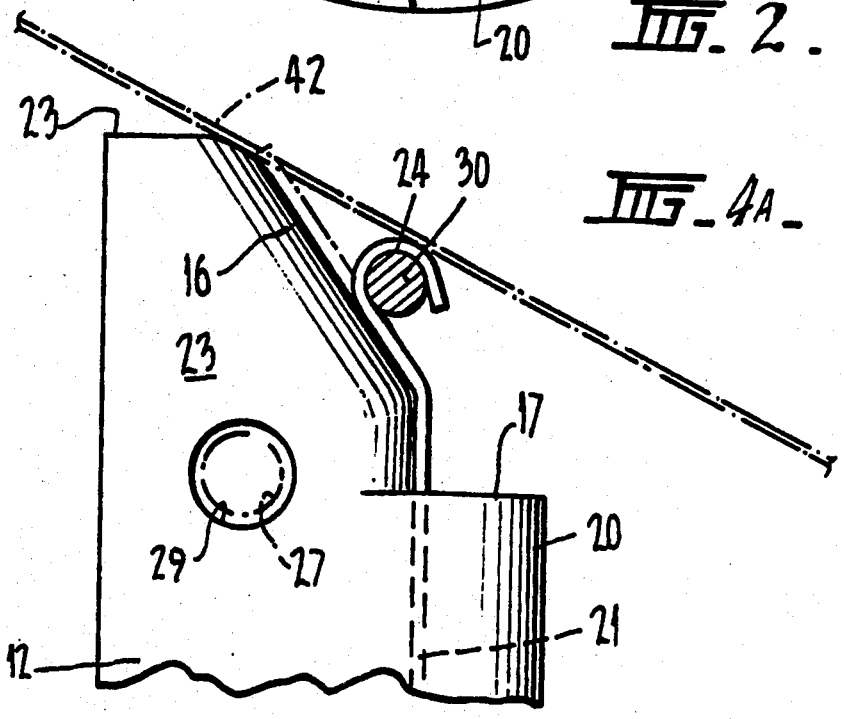
FIGS. 4A is an enlarged view of the detail circled in FIG. 3 illustrating the means of securing a standard panel.

As shown with particular reference to FIGS. 2 to 4 each panel is pre-cast in reinforced concrete. Each panel 12 is of substantially rectangular cross-section with a smooth exterior 20. The majority of the panels 12 are in the standard form illustrated in FIGS. 3 and 4A. Each standard panel is cast around a piece of steel wire 21 that acts both as a reinforcement of the panel as well as means to secure the panels in the array illustrated in FIG. 2. The reinforcement wire is arranged to extend out of the upper end 23 of each standard panel to be formed into a hooked end 24 that is attached to a circular steel ring 30 in a circular array as shown in FIG. 2. Suitable spacer members may be positioned between adjacent panels to define a longitudinal gap 34 between each panel.

As shown in FIG. 4A the upper end 23 of a standard panel has a curved cut-away face 16 that merges into a ledge 17 that extends to the curved exterior 20 of the panel. The end 24 of the wire reinforcement initially extends in parallel abutting contact with the cut-away face 16 (see dotted profile). The steel ring 30 is wedged over the array of panels against the face of the cut-aways 16. The end 24 of the wire reinforcement is then bent over the ring 30 to form a hook.

The opposite end 36 of each panel is provided with a pair of downwardly extending lugs 38 that are located in suitable positioned recesses 39 arranged to be formed in the pre-cast concrete base member 11. It is understood that the pre-cast base member 11 would be located flat in an evenly supported manner on the ground surface.

The frusto-conical cover member 14 is formed of sheetmetal and has at its upper surface 40 a centrally positioned aperture 41. The cover member 14 is arranged to rest on the upper ends 23 of the array of panels with the inclined outer surface 42 of the cover member extending over and outwardly of the metal ring 30. The The conical cover member is shown in dotted profile in FIG. 4A. The cover member 14 is thus easily removable from the top of the array of panels. A cap 15 also formed of sheetmetal is arranged to be displaceable from the aperture 41 in the upper surface 40 of the cover member. The cap 15 has a suitable downwardly extending annular location flange 44 to ensure positive location within the aperture 41 of the cover member. It is understood that a spacer member 50 may optionally be provided between the cap 15 and the cover member. The spacer member 50 provides the advantage that the opening 40 can be enlarged to provide improved access to the interior of the incinerator. As shown in FIG. 3 a suitable sheet of metal gauze 51 may be positioned across the aperture 41 at the upper end of the cover member to act as a spark arrester to prevent unwanted discharge of sparks when the incinerator is in use. It is understood that the spark arrester 51 does not affect the discharge of smoke.

In the normal assembled position the cap 15 is positioned over the cover member 14 to protect the interior of the incinerator from rain. To use the incinerator the cap member is removed or alternatively the whole cover assembly may be removed and the material to be incinerated is positioned into the array of panels from the top. The panels are specifically arranged in an array defining longitudinal gaps between adjacent panels to ensure adequate entry of air into the enclosure defined by the array. Air enters via the gaps to ensure good combustion of the contents of the incinerator. The ash would collect towards the bottom of the incinerator.

Figure 5:
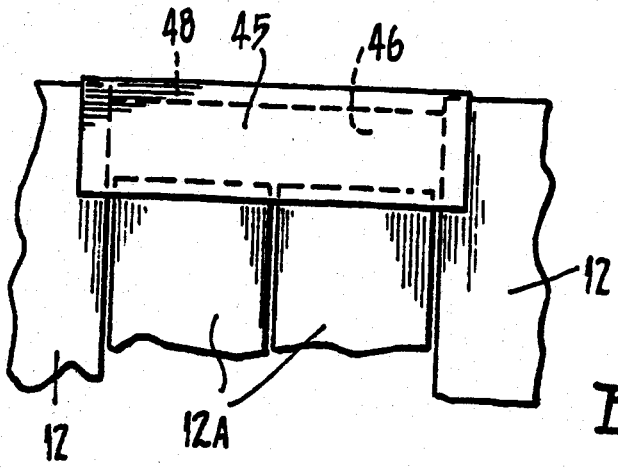
FIG. 5 is a side view illustrating the location of a baffle plate.

In the preferred embodiment of this invention the ash is removed from the incinerator by the simple exercise of lifting two or more panels to define a gap in the incinerator from which the ash can be simply removed. For this purpose two or more special panels are provided and are referred to as ash removal panels. These panels and their association with the standard panels are illustrated in FIGS. 4B and 5. Each ash removal panel 12A is shorter than the standard panel 12. The panel 12A is cast around two reinforcing wires 25, each of which includes a projecting hook 26. A separator bar 27 is arranged to extend between two adjacent standard panels 12 to define the gap that is filled by the ash removal panels 12A. Opposite ends of the separator bar 27 is located with holes 29 positioned in the adjacent standard panels 12. The ash removal panels are hung from the separator bar 27 as shown in FIG. 4B. As shown in FIGS. 4B and 5 a steel baffle plate 45 is supported on the top of the adjacent standard panels 12 to extend across the gap 46 between the top of the standard panels 12 and the top of the ash removal panels 12A. The baffle plate has a bent upper portion 48 that is located on the upper surface of the standard panels 12. The baffle plate 45 assists combustion by blocking off the opening above the ash removal panels and also protects the separator bar 27 and hooks 26 of the ash removal panels 12A.

To effect removal of ash the panels 12A can be lifted clear of the bar 27 up to the top level of the panels 12 to define a suitable gap at the base of the incinerator.

Figure 6:
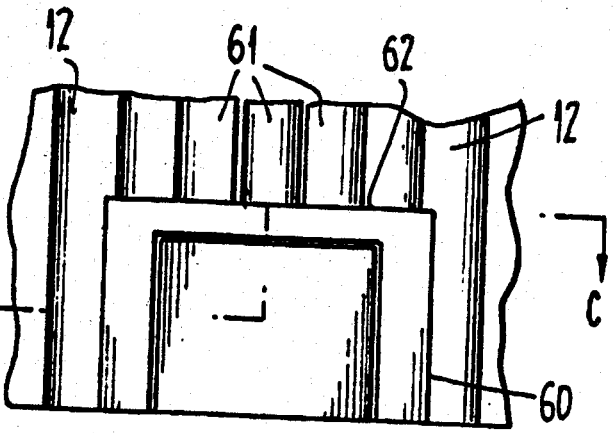
FIG. 6 is a elevational view of a door assembly at the base of an alternative form of incinerator.
Figure 7:
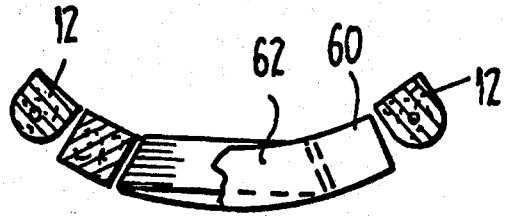
FIG. 7 is a cross-sectional view taken along the lines C—C of FIG. 6.

In an alternative form illustrated in FIGS. 6 and 7 a suitable framework 60 may be provided adjacent the base of the incinerator with some panels 61 being shorter than the other panels to rest on the roof 62 of the framework. The framework 60 defines a rectangular opening in the form of a door that can be removed for ready access to the contents of the incinerator. However it is considered that the inherent simplicity of having displaceable ash removal panels is a more efficient way of removing ash from the incinerator.

The cover member 14 is specifically designed to operate as a heat sink or chimney to cause the hot air within the incinerator to rise whereby improving the drawing capacity of the incinerator. The cover member 14 together with the cap 15 also has the advantage of strengthening the whole assembly and protecting the interior of the incinerator from the weather when the incinerator is not in use. The provision of a plurality of longitudinal extending gaps between adjacent panels provides excellent entry of air and thus ensures improved combustion over existing incinerators where the entry of air is confined to the base of the incinerator that is often clogged by ash and debris.

The incinerator described above is specifically designed to be sold as a kit of parts. The use of pre-cast reinforced panels of concrete that simply hang from a steel ring in a cylindrical array provides a simple means of manufacturing and assembling a very effective incinerator. The facility for lifting two or more panels to effect release of the ash is a very simple means of ensuring easy ash disposal. The incinerator has been specifically designed to ensure good combustion to reduce the production of smoke and unwanted toxic gases. The cover member 14 improves the combustion qualities of the incinerator and also acts as a strengthening member for the whole assembly.

The pre-cast panels are cast in the form illustrated to ensure that the incinerator has an aesthetically pleasing external appearance. It is understood that the whole assembly may be enclosed in a cylinder 70 of galvanized steel mesh (FIG. 3). The cylinder of mesh would act as a screen against the unwanted escape of sparks. However the size of the gaps between adjacent panels is arranged to ensure that there is no escape of ash and debris from the incinerator when in use.

The provision of the gaps between adjacent panels not only improves combustion but allows the components of the assembly, in use, to freely expand and contract in 3 dimensions thereby compensating for thermal and other dimensional changes.

The gaps between adjacent panels may be defined by the location of the lugs in the base of the panels into the base plate or by the use of suitable spacing members which may be attached to the metal ring to define the spacing between each panel. Alternatively the panels may be cast to have lateral projections which prevent line to line abutting contact of the sides of adjacent panels.

It is understood that to further improve the combustion of the incinerator the panels may be arranged so that the gap between adjacent panels increases towards the base of the incinerator. Another means of improving combustion is to provide the inner surface of each panel with projections that in use have the effect of spacing the contents from the wall of the enclosure thereby improving air circulation.

The above description relates to a preferred embodiment of the invention and it is understood that many variations and modifications are possible still falling within the broad concept of the invention.

Two variations concern the design of the panels and the cross-section of the array. It is understood that the panels may be pre-cast with any number of different cross-sections and that the panels may be mounted in non-circular arrays to define rectangular or other shaped enclosures.

Having now described my invention what I claim is:

1. An incinerator comprising panels secured together in an array to define a vertical enclosure with narrow gaps between adjacent panels, at least two of the panels being shorter than the other panels and being arranged to be lifted to define a gap at the base of the incinerator to facilitate ash removal, and a removable cover member arranged to sit on the top of the array of panel, the cover member being of hollow construction and having a cross-section that converges upwardly to a smoke discharge aperture, the cover member acting both as a weather protective roof and a chimney to encourage the drawing capacity of the incinerator.

2. An incinerator according to claim 1, wherein the panels are secured in the array with longitudinal gaps between adjacent panels by a metal ring that extends around the upper ends of the panels.

3. The incinerator according to claim 2 wherein each panel is constructed of concrete pre-cast around a longitudinally extended metal rod, that, in use, is hooked onto the metal ring.

4. An incinerator according to claim 1, wherein the panels are located on a concrete base plate that is provided with means to locate the position of the lower ends of the panels.

5. The incinerator according to claim 4, wherein the panels are arranged in a circular array.

6. An incinerator according to claim 1, wherein the removable cover member is frustoconical and sits on the upper end of the assembled panels.

7. An incinerator according to claim 1, wherein a spark arrestor in the form of gauze is positioned over the cover member to present escape of sparks but allow free escape of smoke.

8. The incinerator according to claim 1, wherein each of said shorter panels is cast around a longitudinally extending piece of rod that is hooked at the upper end, and a transverse rod is positioned between adjacent longer panels so that the shorter panels may be hung from the transverse rod.

9. An incinerator according to claim 8, wherein the upper ends of the panels are provided with inwardly inclined walls that define a frustoconical surface onto which a metal ring is wedged to secure the panels in the array.

10. An incinerator according to claim 1, wherein the panels are made of concrete and the cover member is made of sheet metal.

11. An incinerator according to claim 1 further comprising a removable cap of conical profile configured to sit over the smoke discharge aperture when the incinerator is not in use.

12. An incinerator according to claim 1, wherein the cross-section of each panel is arranged so that when assembled the longitudinal gaps increase in cross-section towards the base of the incinerator.

13. An incinerator comprising panels secured together in an array to define a vertical enclosure with narrow gaps between adjacent panels, the upper ends of the panels having inwardly inclined walls that define a frustoconical surface onto which a ring is wedged to secure the panels in the array, and a removable cover member arranged to sit on the top of the array of panels, the cover member being of hollow construction and having a cross-section that converges upwardly to a smoke discharge aperture, the cover member acting both as a weather protective roof and a chimney to encourage the drawing capacity of the incinerator.

* * * * *

UNITED STATES PATENT AND TRADEMARK OFFICE

CERTIFICATE OF CORRECTION

PATENT NO. : 4,655,193

DATED : April 7, 1987

INVENTOR(S) : Arnold M. Blacket

It is certified that error appears in the above-identified patent and that said Letters Patent is hereby corrected as shown below:

In Column 5, line 21, please delete the word "panel" and insert therefor -- panels --.

In Column 6, line 6, please delete the word "present" and insert therefor -- prevent --.

Signed and Sealed this

First Day of December, 1987

*Attest:*

DONALD J. QUIGG

*Attesting Officer*

*Commissioner of Patents and Trademarks*